US007661613B1

(12) United States Patent
Pan

(10) Patent No.: US 7,661,613 B1
(45) Date of Patent: Feb. 16, 2010

(54) PAPER SHREDDER WITH DUST CLEANER

(75) Inventor: Yung-Tai Pan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/399,665

(22) Filed: Mar. 6, 2009

(30) Foreign Application Priority Data

Dec. 12, 2008 (TW) ..... 097148373

(51) Int. Cl.
*B02C 25/00* (2006.01)

(52) U.S. Cl. ..... 241/36; 241/100; 241/101.3; 241/236

(58) Field of Classification Search ..... 241/100, 241/236, 33, 37.5, 101.2, 101.3
See application file for complete search history.

(56) References Cited

U.S. PATENT DOCUMENTS 5,897,065 A * 4/1999 Schwelling ..... 241/100
6,978,954 B2 * 12/2005 Kroger et al. ..... 241/36

* cited by examiner

*Primary Examiner*—Faye Francis
(74) *Attorney, Agent, or Firm*—Kirton & McConkie; Evan R. Witt

(57) ABSTRACT

A paper shredder includes a shredder body, a bin, a sensing module and a dust cleaner. The dust cleaner has a cleaning element for cleaning the sensing module. The cleaning element is attached on a swing rod. The swing rod has a first end adjacent to the sensing module and a second end inserted into the bin. During the bin is withdrawn from the paper shredder, the swing rod is swung by the inner wall of the bin and thus the cleaning element is contacted with the sensing module to clear off the dust on the sensing module.

8 Claims, 5 Drawing Sheets

PAPER SHREDDER WITH DUST CLEANER

FIELD OF THE INVENTION

The present invention relates to a paper shredder, and more particularly to a paper shredder with a dust cleaner.

BACKGROUND OF THE INVENTION

Paper shredders are used to cut paper into strips or fine particles. According to the size and shape of the shreds produced by the paper shredders, paper shredders are generally classifies into two major types, i.e. strip-cut paper shredders and cross-cut paper shredders. In the strip-cut paper shredder, the cutting blades are disposed regularly on the rotary wheels and cut the along the longitudinal direction into long stripes. In the cross-cut paper shredder, each blade has several hook-shaped cutting edges. The blades are disposed in a spiral way on the rotary wheels. The paper is not only cut along the longitudinal direction into stripes, but also cut in the transverse direction into chips. In this context, the paper stripes or chips are also referred as paper shreds.

Generally, the paper shredder has a trash basket or bin for accommodating the paper shreds. Since the light-weighted paper shreds freely fall into the bin and are accumulated in a random manner, the bin is readily filled with the paper shreds. When the bin is full, the paper shreds in the bin may hinder the follow-up paper shreds from falling into the bin. In a case that the paper shreds in the bin are turned back into the gaps between the cutting blades, a paper jam event occurs and the normal operation of the paper shredder is usually obstructed. For solving the paper jam event, it is necessary to empty or clean the bin when the bin is full.

For realizing whether the bin is filled with the paper shreds, the conventional paper shredder has a sensing module for detecting the paper shreds. When the bin is full, an illuminator emits a warning light beam to notify the user of emptying the paper shreds that are within the bin.

FIG. 1 is a schematic perspective view illustrating a conventional paper shredder. As shown in FIG. 1, the conventional paper shredder 1 comprises a shredder body 10, a bin 11 and a sensing module. The sensing module is disposed on the shredder body 10 and comprises a light emitter 12 and a light receiver 13. The light emitter 12 and the light receiver 13 are disposed near two opposite inner surfaces of the shredder body 11. The light emitter 12 is for example a light emitting diode (LED). Normally, the light emitter 12 continuously emits a light beam to be received by the light receiver 13. When the bin 11 is full and the paper shreds overflow into the receptacle within the shredder body 10, the light beam is obstructed by the paper shreds. Since the light beam is obstructed by the paper shreds, no light beam is received by the light receiver 13. Meanwhile, the sensing module realizes that the bin 11 is full and thus an illuminator is turned on to emit a warning light beam to notify the user.

The use of the sensing module to realize whether the bin is full, however, still has some drawbacks. For example, the illuminator is often erroneously turned on to emit the warning light when dust or paper shreds are accumulated or adsorbed on the surface of the light emitter 12 or the light receiver 13 because the light beam emitted from the light emitter 12 is obstructed by the dust or paper shreds. The phenomenon of erroneously generating the warning light is not caused by the full bin. For the cross-cut paper shredders, the phenomenon of erroneously generating the warning light is frequently found. For preventing from erroneously generating the warning light, it is very troublesome for the user to frequently clean the surfaces of the light emitter 12 and the light receiver 13.

Therefore, there is a need of providing a paper shredder with a dust cleaner so as to obviate the drawbacks encountered from the prior art.

SUMMARY OF THE INVENTION

It is an object of the present invention to provide a paper shredder with a dust cleaner in order to preventing from erroneously generating the warning light.

In accordance with an aspect of the present invention, there is provided a paper shredder. The paper shredder includes a shredder body, a bin, a sensing module and a dust cleaner. The shredder body has a shredder mechanism mounted therein for cutting a paper into multiple paper shreds. The bin is disposed under the shredder body for accommodating the paper shreds. The sensing module is disposed on the shredder body for realizing whether the bin is filled with the paper shreds. The dust cleaner is used for cleaning the sensing module and includes an external cover and a swing rod. The external cover is disposed adjacent to the sensing module. The swing rod has a first end pivotally coupled with the external cover and a second end inserted into the bin. A cleaning element is attached on the swing rod.

In an embodiment, a first pivotal hole and a perforation are formed in a sidewall of the external cover, wherein the swing rod is pivotally coupled with the first pivotal hole.

In an embodiment, the sensing module emitting part comprises a light emitter and a lamp holder.

In an embodiment, the lamp holder is disposed within the external cover.

In an embodiment, the lamp holder includes a second pivotal hole, a recess structure and a sensing window. The light emitter is accommodated within the recess structure of the lamp holder.

In an embodiment, the swing rod further comprises a first shaft pivotally coupled with the first pivotal hole and a second shaft pivotally coupled with the second pivotal hole.

In an embodiment, the paper shredder further includes a helix covering, which is sheathed around the swing rod.

In an embodiment, the cleaning element is a brush.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
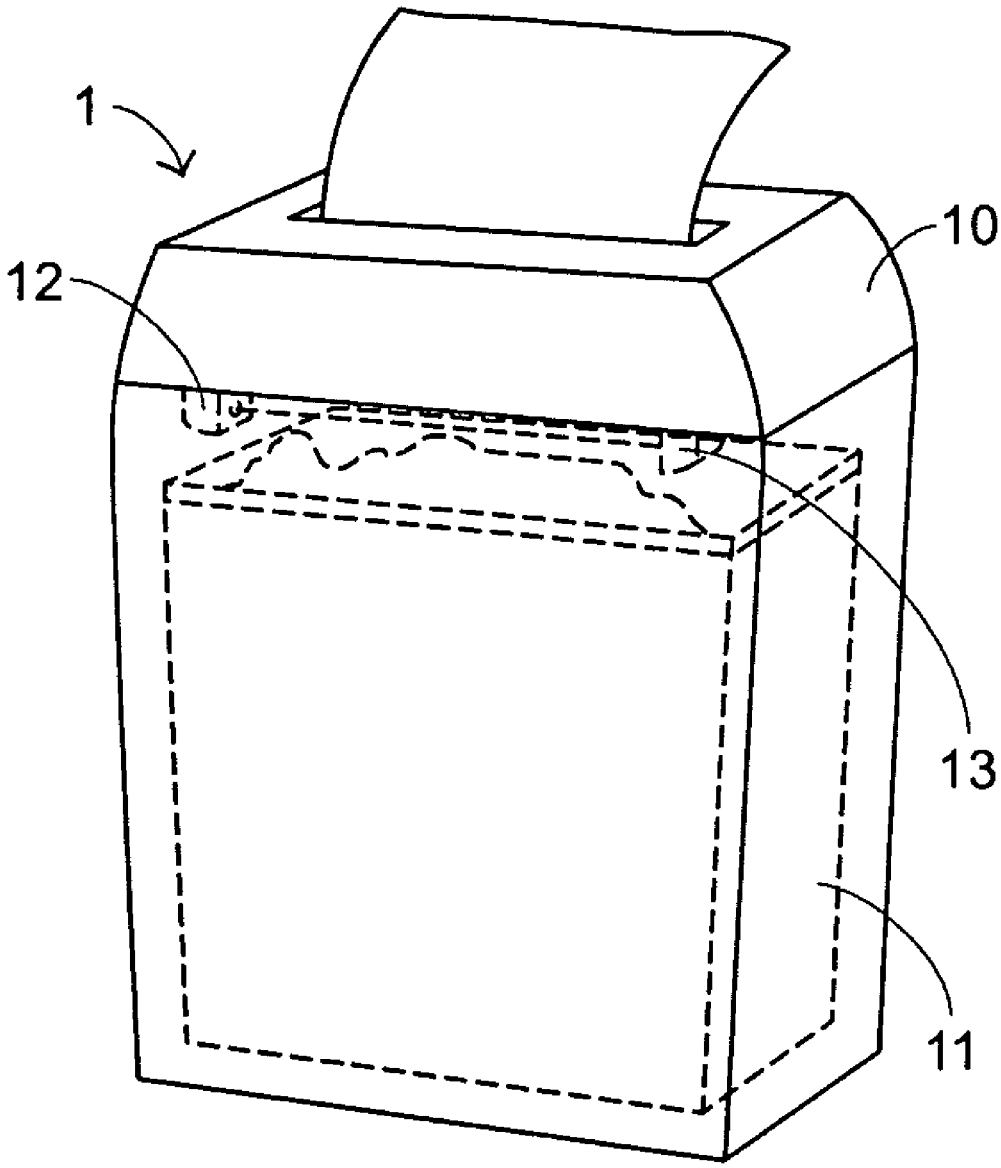
FIG.1 PRIOR ART
FIG. 1 is a schematic perspective view illustrating a conventional paper shredder.
Figure 2:
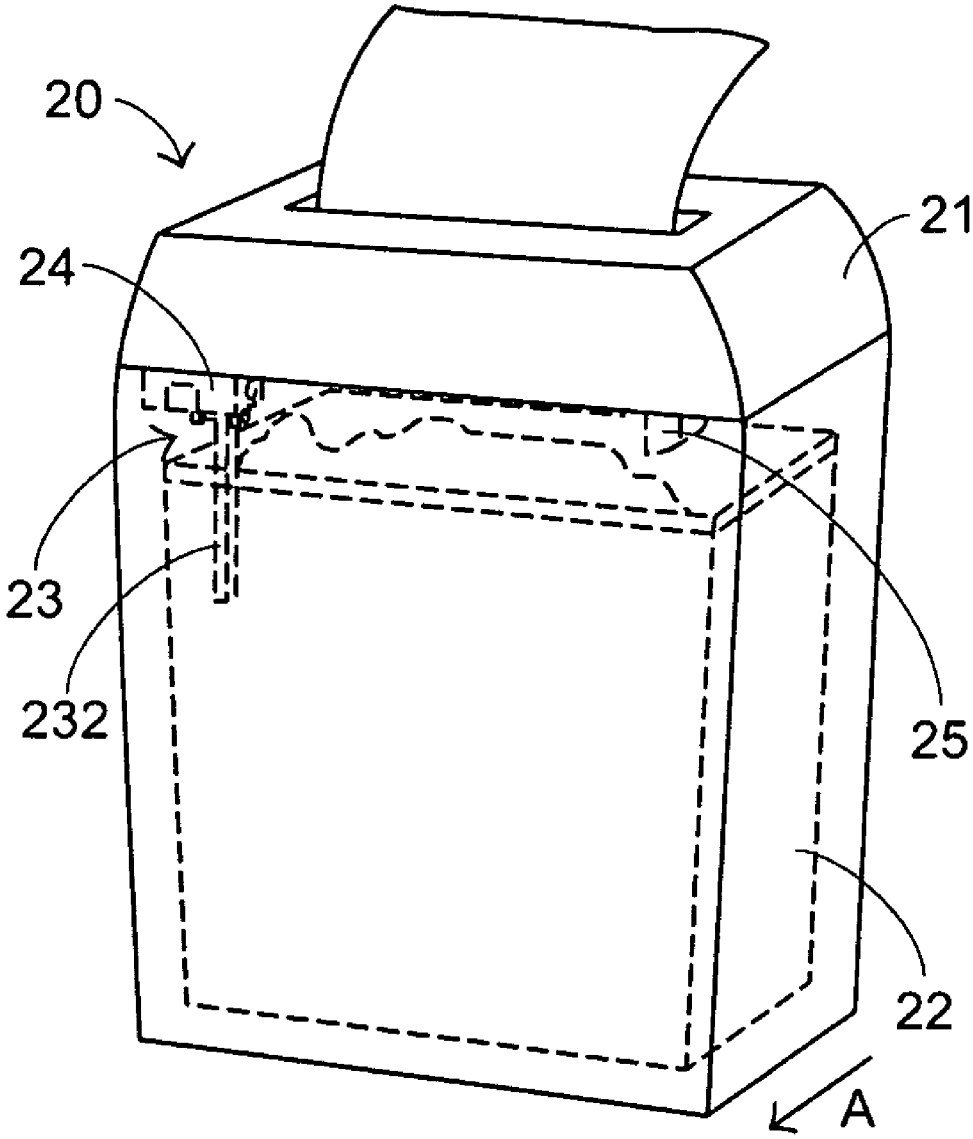
FIG. 2 is a schematic perspective view illustrating a paper shredder with a dust cleaner according to a preferred embodiment of the present invention.

FIG. 2 is a schematic perspective view illustrating a paper shredder with a dust cleaner according to a preferred embodiment of the present invention. As shown in FIG. 2, the paper shredder 20 comprises a shredder body 21, a bin 22, a sensing module and a dust cleaner 23. The shredder body 21 has a shredder mechanism mounted therein for cutting a paper inserted into the shredder opening. For clarification and brevity, the shredder mechanism is not shown in the drawings. The operation principle of the shredder mechanism is known in the art, and is not redundantly described herein. The bin 22 is disposed under the shredder body 21. After the paper is cut by the shredder mechanism, the paper shreds directly fall into the bin 22. That is, the bin 22 is used for accommodating the paper shreds. The sensing module is disposed within the receptacle of the shredder body 21 for detecting the paper shreds. The sensing module comprises a sensing module emitting part 24 and a sensing module receiving part 25.

The dust cleaner 23 is used for clean the surfaces of the sensing module emitting part and the sensing module receiving part. In this embodiment, the dust cleaner 23 is disposed adjacent to the sensing module emitting part. Alternatively, the dust cleaner 23 is disposed adjacent to the sensing module receiving part. For enhancing the cleaning efficacy, the paper shredder 20 may include two dust cleaners 23 in some embodiments, wherein one dust cleaner 23 is disposed adjacent to the sensing module emitting part and the other dust cleaner 23 is disposed adjacent to the sensing module receiving part.

Figure 3:
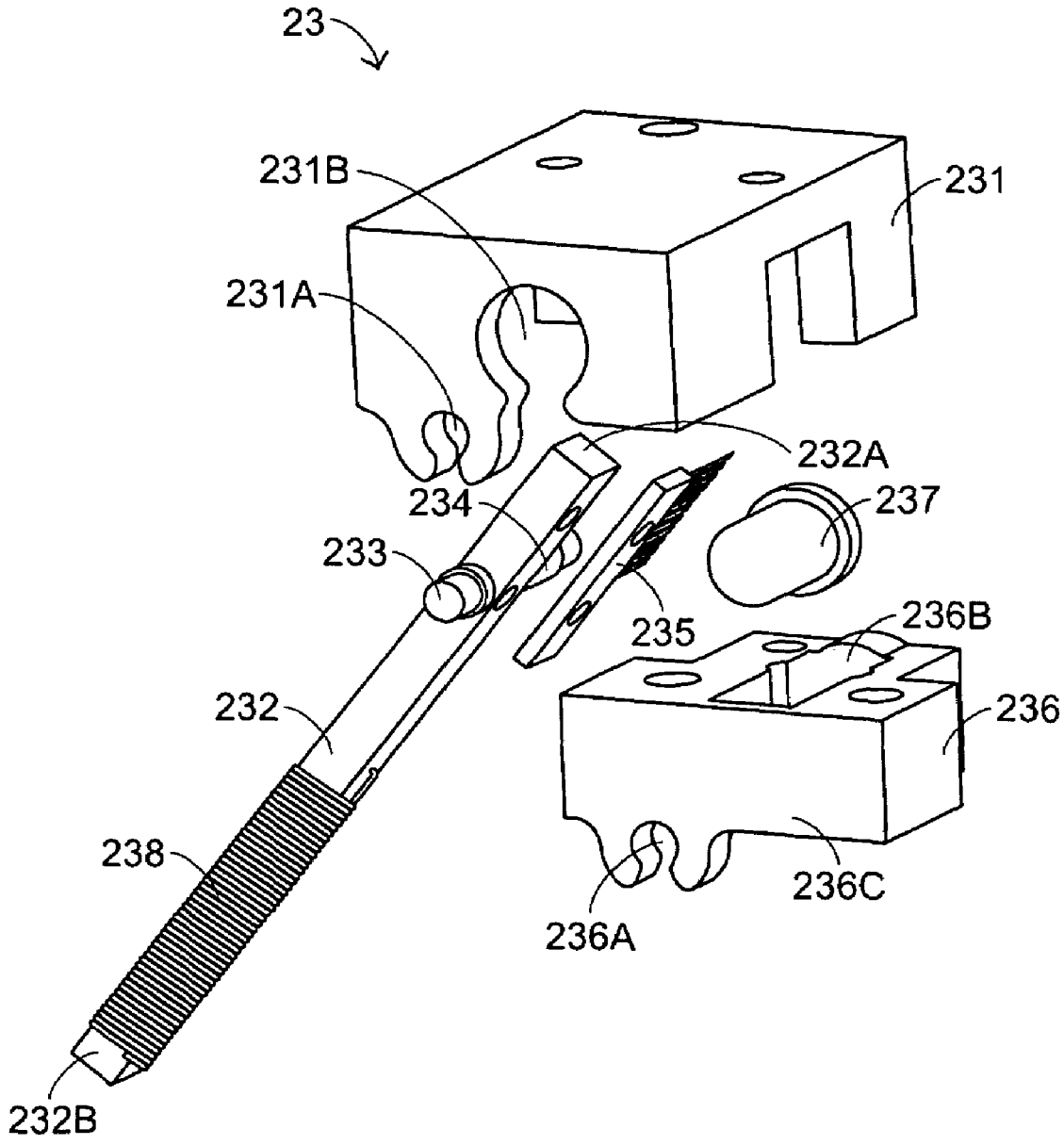
FIG. 3 is a schematic exploded view illustrating an exemplary dust cleaner used in the paper shredder of the present invention.

FIG. 3 is a schematic exploded view illustrating an exemplary dust cleaner used in the paper shredder of the present invention. As shown in FIG. 3, the dust cleaner 23 comprises an external cover 231 and a swing rod 232.

The external cover 231 comprises a first pivotal hole 231A and a perforation 231B in a sidewall of the external cover 231. The swing rod 232 has a first end 232A, a second end 232B, a first shaft 233 and a second shaft 234. The cleaning element 235 is fixed on the swing rod 232. An example of the cleaning element 235 is a brush with bristles. Moreover, the sensing module emitting part 24 comprises a light emitter 237 and a lamp holder 236. The light emitter 237 is for example a light emitting diode (LED). The lamp holder 236 has a second pivotal hole 236A, a recess structure 236B and a sensing window 236C. During operation of the paper shredder 20, the light emitter 237 continuously emits a light beam. The light beam is penetrable through the sensing window 236C.

Figure 4:
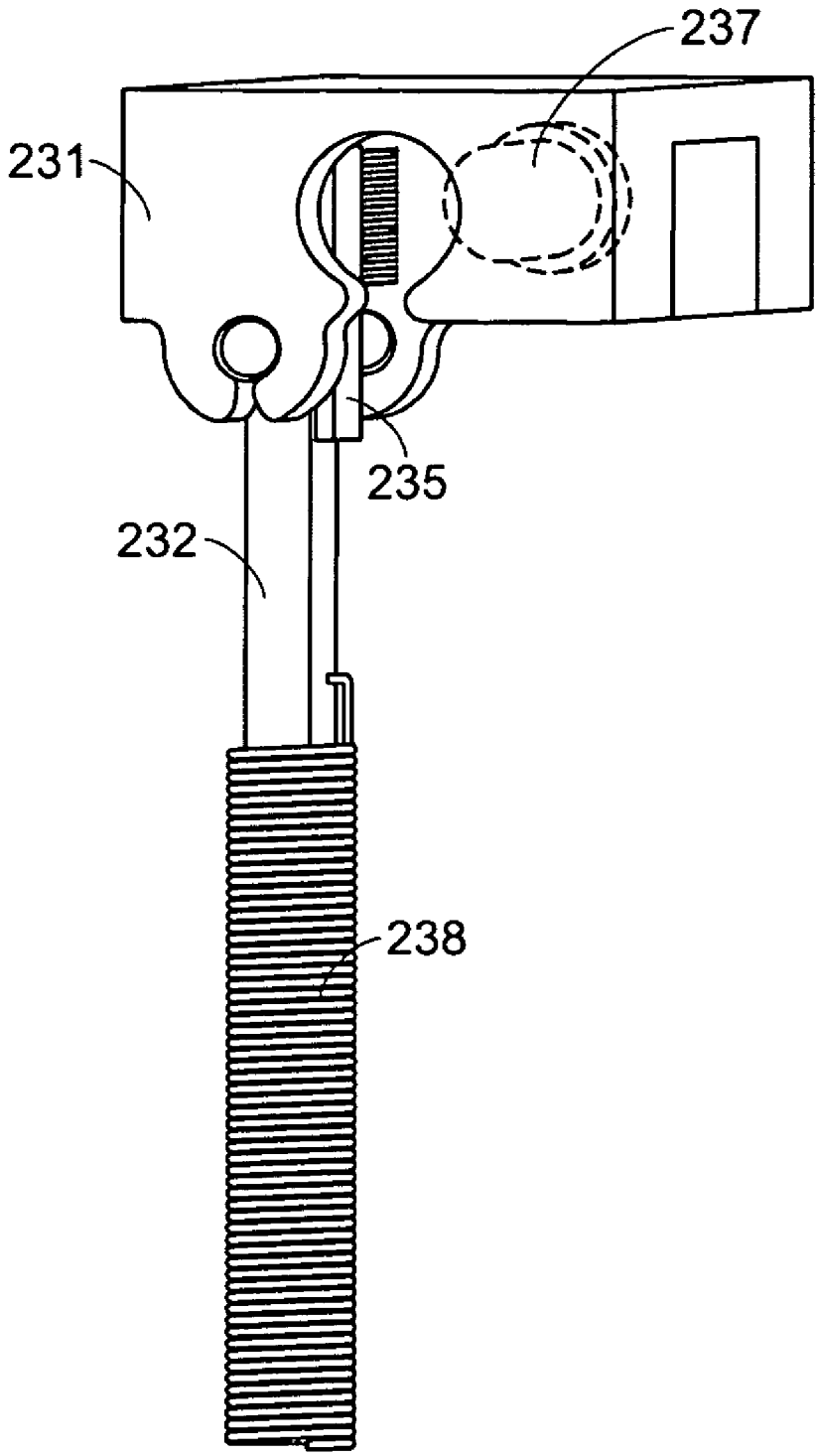
FIG. 4 is a schematic assembled view of the dust cleaner used in the paper shredder shown in FIG. 3.

FIG. 4 is a schematic assembled view of the dust cleaner used in the paper shredder shown in FIG. 3. Please refer to FIGS. 2, 3 and 4. The external cover 231 is fixed on the shredder body 21. The first shaft 233 of the swing rod 232 is pivotally coupled to the first pivotal hole 231A of the external cover 231. The light emitter 237 (i.e. the LED) is accommodated within the recess structure 236B of the lamp holder 236. The lamp holder 236 is disposed within the external cover 231. The second shaft 234 of the swing rod 232 is pivotally coupled to the second pivotal hole 236A of the lamp holder 236. After the dust cleaner 23 is assembled as shown in FIG. 4, the swing rod 232 is swingable with respect to the external cover 231. In some embodiments, the paper shredder 20 further comprises a helix covering 238. The helix covering 238 is sheathed around the swing rod 232 for protecting the surface of the swing rod 232 from being damaged by collision.

Figure 5:
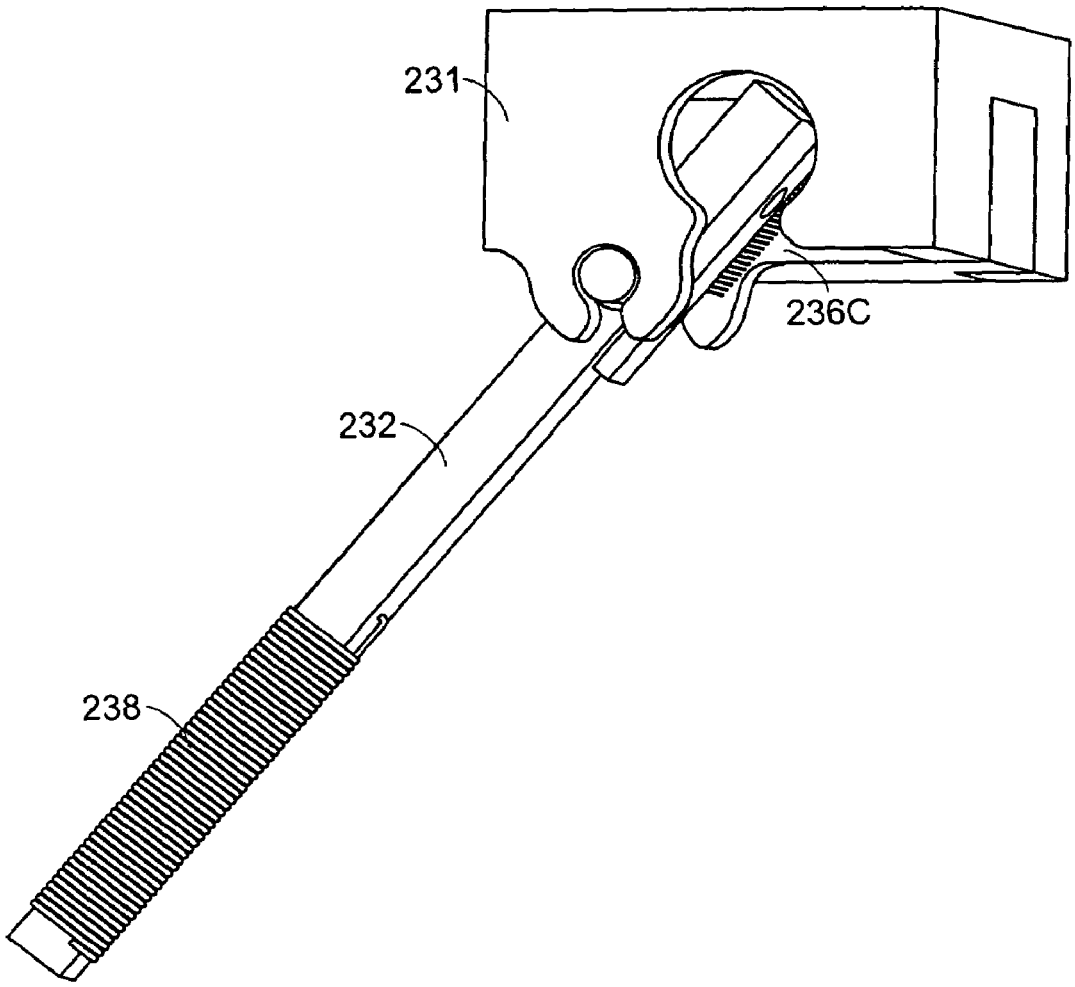
FIG. 5 is a schematic perspective view illustrating the dust cleaner that swings to clean the light emitter.

Hereinafter, the operations of the dust cleaner 23 will be illustrated with reference to FIGS. 2, 4 and 5. As shown in FIG. 2, the first end 232A of the swing rod 232 of the dust cleaner 23 is accommodated within the external cover 231, and the second end 232B of the swing rod 232 is uprightly inserted into the bin 22 due to gravity. Since the swing rod 232 is pivotally coupled to the external cover 231, the swing rod 232 may be swung with respect to the external cover 231 if an external force is exerted on the second end 232B of the swing rod 232. Generally, the user may withdraw the bin 22 from the paper shredder 20 in the direction A if the sensing module detects that the bin 22 is filled with the paper shreds. During the bin 22 is withdrawn from the paper shredder 20, the second end 232B of the swing rod 232 is contacted by the inner surface of the bin 22 and thus the swing rod 232 is swung toward the direction A. As the swing rod 232 is swung, the cleaning element 235 is also swung to brush the sensing window 236C of the lamp holder 236 (as shown in FIG. 5). Moreover, the perforation 231B of the external cover 231 may prevent the paper shreds from accumulating inside the external cover 231. After the bin 22 is pushed back into the paper shredder 20, the external force exerted on the swing rod 232 is eliminated and thus the swing rod 232 is swung back. Meanwhile, the cleaning element 235 is returned to its original position to ne uprightly inserted into the bin 22 while brushing the sensing window 236C of the lamp holder 236 again.

From the above embodiment, since the cleaning element is attached on the swing rod, the cleaning element can clean the sensing element when the swing rod is swung. During the bin is withdrawn from the paper shredder, the swing rod is corresponding swung to clean the sensing module, and thus no additional cleaning procedure is required to clean the sensing module. In other words, the dust cleaner is very cost-effective and user-friendly.

While the invention has been described in terms of what is presently considered to be the most practical and preferred embodiments, it is to be understood that the invention needs not be limited to the disclosed embodiment. On the contrary, it is intended to cover various modifications and similar arrangements included within the scope of the appended claims which are to be accorded with the broadest interpretation so as to encompass all such modifications and similar structures.

What is claimed is:

1. A paper shredder with a dust cleaner, said paper shredder comprising:

a shredder body having a shredder mechanism mounted therein for cutting a paper into multiple paper shreds;

a bin disposed under said shredder body for accommodating said paper shreds;

a sensing module disposed on said shredder body for realizing whether said bin is filled with said paper shreds; and said dust cleaner for cleaning said sensing module and comprising:

an external cover disposed adjacent to said sensing module; and a swing rod having a first end pivotally coupled with said external cover and a second end inserted into said bin, wherein a cleaning element is attached on said swing rod.

2. The paper shredder with a dust cleaner according to claim 1 wherein a first pivotal hole and a perforation are formed in a sidewall of said external cover, wherein said swing rod is pivotally coupled with said first pivotal hole.

3. The paper shredder with a dust cleaner according to claim 2 wherein said sensing module emitting part comprises a light emitter and a lamp holder.

4. The paper shredder with a dust cleaner according to claim 3 wherein said lamp holder is disposed within said external cover.

5. The paper shredder with a dust cleaner according to claim 4 wherein said lamp holder comprises a second pivotal hole, a recess structure and a sensing window, wherein said light emitter is accommodated within said recess structure of said lamp holder.

6. The paper shredder with a dust cleaner according to claim 5 wherein said swing rod further comprises a first shaft pivotally coupled with said first pivotal hole and a second shaft pivotally coupled with said second pivotal hole.

7. The paper shredder with a dust cleaner according to claim 1 wherein said paper shredder further comprises a helix covering, which is sheathed around said swing rod.

8. The paper shredder with a dust cleaner according to claim 1 wherein said cleaning element is a brush.

* * * * *